US011668039B2

(12) United States Patent
Kessler et al.

(10) Patent No.: US 11,668,039 B2
(45) Date of Patent: Jun. 6, 2023

(54) METHOD FOR WASHING LAUNDRY OF A WASH LOAD

(71) Applicant: Henkel AG & Co. KGaA, Duesseldorf (DE)

(72) Inventors: Arnd Kessler, Monheim am Rhein (DE); Anna Klemmer, Duesseldorf (DE); Peter Schmiedel, Duesseldorf (DE); Thomas Juckel, Monheim (DE); Christian Nitsch, Duesseldorf (DE)

(73) Assignee: HENKEL AG & CO. KGAA, Duesseldorf (DE)

( * ) Notice: Subject to any disclaimer, the term of this patent is extended or adjusted under 35 U.S.C. 154(b) by 171 days.

(21) Appl. No.: 16/640,477

(22) PCT Filed: Aug. 14, 2018

(86) PCT No.: PCT/EP2018/071972
§ 371 (c)(1),
(2) Date: Feb. 20, 2020

(87) PCT Pub. No.: WO2019/042756
PCT Pub. Date: Mar. 7, 2019

(65) Prior Publication Data

US 2020/0216995 A1 Jul. 9, 2020

(30) Foreign Application Priority Data

Aug. 29, 2017 (DE) ..... 10 2017 215 038.6

(51) Int. Cl.
*D06F 33/37* (2020.01)
*D06F 105/48* (2020.01)
(Continued)

(52) U.S. Cl.
CPC ..... *D06F 33/37* (2020.02); *D06F 33/57* (2020.02); *D06F 33/36* (2020.02); *D06F 35/006* (2013.01);
(Continued)

(58) Field of Classification Search
CPC ..... D06F 39/008; C11D 17/0021
See application file for complete search history.

(56) References Cited

U.S. PATENT DOCUMENTS 8,313,535 B2 11/2012 Schaub et al.
9,284,678 B2 3/2016 Hanau et al.
(Continued)

FOREIGN PATENT DOCUMENTS

CN 101046043 A 10/2007
CN 102405315 A 4/2012
(Continued)

OTHER PUBLICATIONS

EPO, International Search Report issued in International Application No. PCT/EP2018/071972, dated Nov. 7, 2018.

*Primary Examiner* — Spencer E. Bell
(74) *Attorney, Agent, or Firm* — Lorenz & Kopf, LLP

(57) ABSTRACT

The present disclosure relates to a method for washing laundry of a laundry load, in particular in a washing drum (B2), carried out by at least one device (100, 200). In one example, the method includes generating steam and applying the steam to the laundry of the laundry load; producing a microemulsion by employing a detergent composition; and washing the laundry of the laundry load using a first wash liquor based on the microemulsion.

11 Claims, 3 Drawing Sheets

(51) Int. Cl.

| | |
|---|---|
| ***D06F 105/42*** | (2020.01) |
| ***D06F 103/20*** | (2020.01) |
| ***D06F 103/18*** | (2020.01) |
| ***D06F 103/04*** | (2020.01) |
| ***D06F 103/22*** | (2020.01) |
| ***D06F 33/36*** | (2020.01) |
| ***D06F 35/00*** | (2006.01) |
| ***D06F 33/57*** | (2020.01) |
| *D06F 39/00* | (2020.01) |

(52) U.S. Cl.
CPC ..... *D06F 39/008* (2013.01); *D06F 2103/04* (2020.02); *D06F 2103/18* (2020.02); *D06F 2103/20* (2020.02); *D06F 2103/22* (2020.02); *D06F 2105/42* (2020.02); *D06F 2105/48* (2020.02)

(56) References Cited

U.S. PATENT DOCUMENTS

| | | | | |
|---|---|---|---|---|
| 10,513,675 | B2 | 12/2019 | Schmiedel et al. | |
| 2002/0095483 | A1* | 7/2002 | Lee | H04L 29/06 709/219 |
| 2005/0000031 | A1* | 1/2005 | Price | C11D 11/0064 8/142 |
| 2005/0183208 | A1 | 8/2005 | Scheper et al. | |
| 2008/0276963 | A1* | 11/2008 | Hendrickson | D06F 33/37 134/18 |
| 2009/0172892 | A1* | 7/2009 | Oh | D06F 39/008 8/149.1 |
| 2014/0259441 | A1 | 9/2014 | Fulmer et al. | |
| 2016/0348042 | A1 | 12/2016 | Schmiedel et al. | |
| 2017/0114310 | A1* | 4/2017 | Schmiedel | D06F 35/006 |
| 2018/0044839 | A1* | 2/2018 | Wright | D06F 39/02 |

FOREIGN PATENT DOCUMENTS

| | | | | |
|---|---|---|---|---|
| DE | 102013104075 | A1 | 10/2014 | |
| DE | 102014202990 | A1 | 8/2015 | |
| DE | 102014213314 | A1 | 1/2016 | |
| EP | 1838915 | B1 | 10/2007 | |
| GB | 780981 | A | 8/1957 | |
| GB | 1271074 | A | 4/1972 | |
| JP | 2014158606 | A | 9/2014 | |
| KR | 20150050847 | A | 5/2015 | |
| WO | 2005003268 | A1 | 1/2005 | |
| WO | 2010031675 | A1 | 3/2010 | |
| WO | 2012048911 | A1 | 4/2012 | |
| WO | 2016005462 | A1 | 1/2016 | |
| WO | WO-2016005462 | A1 * | 1/2016 | C11D 11/0017 |

* cited by examiner

METHOD FOR WASHING LAUNDRY OF A WASH LOAD

CROSS-REFERENCE TO RELATED APPLICATION

This application is a U.S. National-Stage entry under 35 U.S.C. § 371 based on International Application No. PCT/EP2018/071972, filed Aug. 14, 2018, which was published under PCT Article 21(2) and which claims priority to German Application No. 10 2017 215 038.6, filed Aug. 29, 2017, which are all hereby incorporated in their entirety by reference.

TECHNICAL FIELD

The present disclosure relates to a method for washing laundry of a laundry load, in particular in a washing drum, carried out by at least one device. In addition, the present disclosure relates to a device, a computer program, a storage medium and a system.

BACKGROUND

Methods for washing laundry of a laundry load are known in the art. The focus of cleaning methods is often a good cleaning of the laundry with a very thorough removal of grease and oil-like dirt. In order to be able to effectively remove the grease stains, the washing methods generally aim to remove at least hydrophobic fractions of the stains. However, in order to then effect the uptake of the hydrophobic fractions of the stains into the wash liquor, a thermodynamically attractive environment for these stains must be created.

However, this goal is often in conflict with the lowest possible water consumption with simultaneous good cleaning. In particular, the heating of the laundry to produce the thermodynamically attractive environment with simultaneous homogeneous mixing and low water consumption pose a problem.

A textile treatment method is known from the prior art of WO 2005/003268 A1, in which soiled textiles are brought into a treatment chamber of the washing machine. A cleaning liquid is brought evenly into the treatment chamber, wherein the textiles are moved. Subsequently, the textiles are rinsed with a rinse liquid containing water to produce free water. At least a part of the rinse liquid is removed from the treatment chamber, which can be repeated with further rinse liquids. The amount of cleaning fluid should be between about 25% and about 200% of the dry weight of the textiles. The heating of the liquid can take place by employing a heating means in the feed.

A method for controlling a washing machine with a laundry tub, a drum, a spraying device, which is suitable for dispensing liquid into an interior of the drum, and a pump-down device, is known is from WO 2012/048911 A1. A cleaning operation in which laundry is treated with a cleaning solution and a rinsing operation in which the cleaning solution is at least substantially removed from the laundry are carried out. In the rinsing operation, the drum is driven to a contact speed at which the laundry rests against the drum due to centrifugal force. The laundry is sprayed with a rinse solution through the spray device while simultaneously pumping free liquid so that no free liquid accumulates within the drum. The laundry is heated with a heating element arranged in the laundry tub.

DE 10 2014 202 990 A1 discloses a mono- or multiphase non-solid concentrate for use as a textile detergent, which is suitable for producing or maintaining a Winsor Type 2 microemulsion system when diluted in a washing machine using a short liquor washing technique. For this purpose, a textile washing method is used in a washing machine having a washing cycle with at least two consecutive sub-washing cycles. Here, a corresponding concentrate is placed in a detergent storage space of the washing machine and transported in the first sub-washing cycle with simultaneous formation of a short liquor in the laundry treatment space of the washing machine. A Winsor Type 2 microemulsion system is formed or maintained as a short liquor so that an interaction of the short liquor of Winsor Type 2 with the dirt present in the laundry batch occurs in the first sub-wash cycle. Subsequently, in at least one further sub-washing cycle, the liquor is further diluted with water until the formation of a long liquor, and the dirt is removed from the laundry treatment space together with the long liquor. The heating preferably takes place in the first sub-washing cycle by employing a heating of the machine.

EP 1 838 915 B1 discloses a method for producing a hydrophobic effect of textiles in a household washing machine with devices for heating a liquor in a laundry tub, in which method hydrophobic active substances dissolved in the liquor are brought into contact with the textiles during a treatment operation similar to a washing operation. The laundry tub is filled with an amount of water measured for a short liquor, that is, at a ratio of weight of the amount of dry textile to weight of the amount of water greater than 1:8. The liquor is heated while wetting the textiles in the laundry tub. A predetermined amount of the hydrophobic active substance is rinsed by employing water from the detergent storage chamber into the laundry tub and forms the liquor together with the water. Then, the textile comes into contact with the liquor for the first time. The liquor is then removed without rinsing by spinning out of the textiles and from the laundry tub.

WO 2010/031675 A1 discloses a method for applying a finishing composition to a laundry item in a laundry treatment device having a rotatably mounted drum. By adding water as the drum rotates, a predetermined residual moisture content is set in the laundry item and the finishing composition is applied to the laundry. The finishing composition is thereby applied in liquid form or in the form of fine droplets (spray) to the laundry by spraying via an application device while the drum is being moved at or above the contact speed.

BRIEF SUMMARY

Methods for washing laundry of a laundry load in a washing drum and carried out by at least one device are provided. In an exemplary embodiment, a method includes generating steam and applying the steam to the laundry of the laundry load. A microemulsion is generated via a detergent composition. The laundry of the laundry load is washed using a first wash liquor based on the microemulsion.

BRIEF DESCRIPTION OF THE DRAWINGS

The present disclosure will hereinafter be described in conjunction with the following drawing figures, wherein like numerals denote like elements, and.

DETAILED DESCRIPTION

Figure 1:
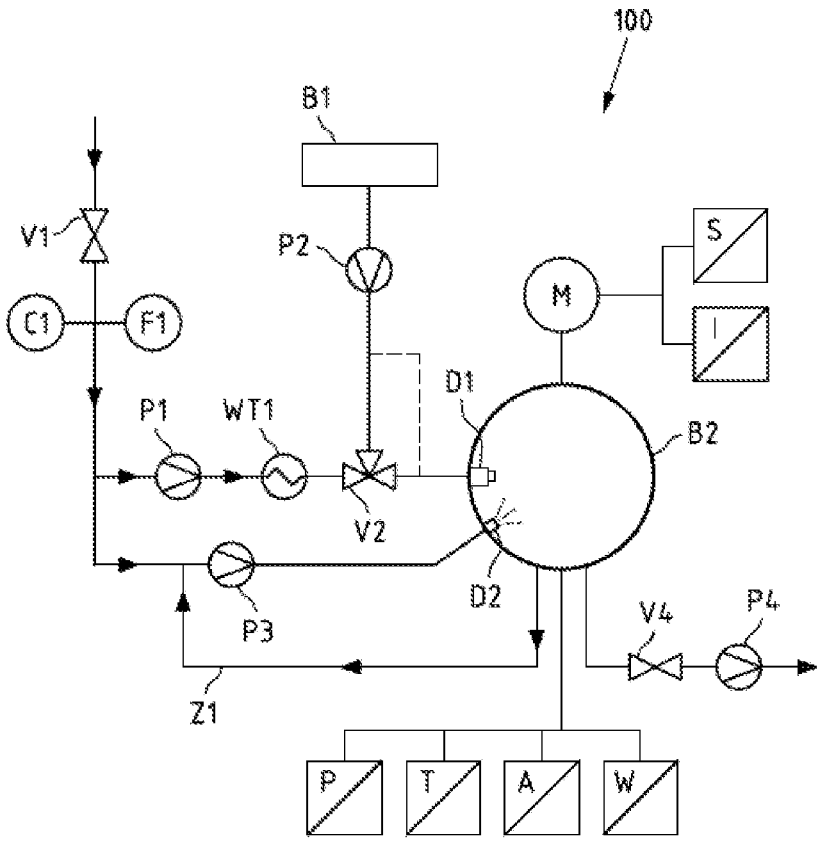
FIG. 1 illustrates a schematic block diagram of an embodiment of a device as contemplated herein for illustrating an embodiment of a method as contemplated herein.

The following detailed description is merely exemplary in nature and is not intended to limit the disclosure or the application and uses of the subject matter as described herein. Furthermore, there is no intention to be bound by any theory presented in the preceding background or the following detailed description.

It has been found that the washing methods of the prior art continue to need to be improved. There is still room for improvement, in particular with regard to a homogeneous moisture penetration and heating of the laundry with short liquors and good cleaning results.

Against the background of the prior art, therefore, the object of the present disclosure is to specify a method with which homogeneous moisture penetration and heating of the laundry with short liquors and good cleaning results is achieved. In addition, a device, a computer program, a storage medium and a system which solve this problem are specified.

The object is achieved in a generic method where the method comprises:

generating steam and applying the steam to the laundry of the laundry load;

producing a microemulsion by employing a detergent composition; and washing the laundry of the laundry load using a first wash liquor based on the microemulsion.

It has been found that a particularly homogeneous moisture penetration with simultaneously homogeneous heating of the laundry is possible by employing the steam. At the same time, a washing by employing a microemulsion, in particularly with short liquors, that is, low water consumption, is feasible through the use of steam. As a result, a warm washing is thus made possible despite short liquors and a good washing result is achieved at the same time.

The method is therefore particularly suitable for warm washing. For example, the laundry, in the context of the method, is at least temporarily washed at least at a temperature of at least about 15° C., preferably at least about 30° C., in particular during washing using the first wash liquor.

The steam is preferably water vapor. Steam is understood in particular to mean the gaseous state of the starting material. Unlike, for example, the use of aerosols or warm air, the steam simultaneously introduces both the moisture to enable a short liquor washing process and the thermal energy (including the recovered enthalpy of condensation). The result is a very uniform moisture penetration and heating of the laundry of the laundry load.

Water is supplied by employing a pump to a steam generator, for example, to generate the steam. The generated steam can then be supplied in particular via one or more nozzles of the washing drum.

The washing drum is in particular a washing drum rotating about a horizontal axis, for example, that of a washing machine formed as a front loader.

In the present case, a microemulsion is understood to mean a thermodynamically stable mixture of water, oil(s) and amphiphile(s). The microstructure can be O/W or W/O as usual for emulsions. Moreover, bicontinuous structures are also found in microemulsions. Most microemulsions are clear since their droplet size in the nm range is well below the wavelength of visible light. Clarity is also considered in the context of the present disclosure as an indicator of the presence of a microemulsion in a water/oil/amphiphile mixture. However, multiphase and/or cloudy microemulsions are also possible. According to Winsor, microemulsion systems including a water component, an oil component and an amphiphile can be subdivided according to their phase equilibria into 4 types which can be used in the present disclosure.

In a Winsor Type I microemulsion system, the surfactant is primarily soluble in water and in an O/W microemulsion form. It includes a surfactant-rich aqueous phase (O/W microemulsion) and an excess but low-surfactant oil phase.

In a Winsor Type II microemulsion system, the surfactant is primarily soluble in an oil phase and in a W/O microemulsion form. It includes a surfactant-rich oil phase (W/O microemulsion) and an excess, but low-surfactant aqueous phase.

A Winsor Type III microemulsion system constitutes a frequently bicontinuous microemulsion, also called a middle-phase microemulsion, of a surfactant-rich middle phase which coexists with a low-surfactant aqueous phase and low-surfactant oil phase.

A Winsor Type IV microemulsion system is a single-phase, homogeneous mixture and, in contrast to the Winsor types I to III, which include 2 or 3 phases of which only one phase is a microemulsion, constitutes a total microemulsion. It usually requires high surfactant concentrations to achieve this single-phase, while significantly less surfactant concentrations are required for Winsor Type I and Type II microemulsion systems to achieve stable phase equilibrium.

Detergent compositions capable of forming a single-phase microemulsion (Winsor IV) under the conditions described are preferred embodiments within the context of the present disclosure.

The detergent composition is thus at least suitable for forming a microemulsion.

Preferably, the detergent composition comprises:

(1) a surfactant system having a fishtail point in the range of from about 0.01% by weight to about 50% by weight, preferably from about 0.1% by weight to about 35% by weight, particularly preferably from about 0.2% by weight to about 25% by weight, containing at least one surfactant selected from anionic, cationic, amphoteric, nonionic surfactants and combinations thereof; and (2) at least one enzyme.

"Fishtail point" as used herein is understood to mean the maximum extension of the single-phase, optically isotropic microemulsion region towards minimum surfactant concentrations at which the upper and lower phase boundaries intersect, delineating the same single-phase region. "Upper phase boundary" and "lower phase boundary" preferably describe the transitions between microemulsion phase (single-phase Winsor IV type microemulsions) and precipitated excess phases (two-phase Winsor I or II type microemulsions) or other structured phases.

The surfactant systems having the fishtail points described can form microemulsions and, therefore, when used in detergent compositions for cleaning textile substrates, advantageously result in reduced water and power consumption, compared to conventional means, and equal or reduced amounts of surfactant to improved removal of particular greasy and oily stains. In particular, a good cleaning with low water consumption is made possible in combining with the generation of steam and applying the steam to laundry of the laundry load.

In the present case, a surfactant system capable of forming a microemulsion is understood in particular to mean an aqueous surfactant system which is capable of solubilizing a relatively large amount of oil without clouding being detectable. Such a system is capable of clearly solubilizing more than about 0.25% by weight, preferably more than about 1% by weight, more preferably more than about 5% by weight of an oil. Usually, such systems are exemplified by a particularly low interfacial tension against the oil in question. Interfacial tensions of <about 5 mN/m are preferred, more preferably <about 0.5 mN/m and most preferably <about 0.05 mN/m. Accordingly, as used herein, "suitable to form a microemulsion" means that these compositions comprise a surfactant system having the described properties and at least one enzyme and under the test conditions described below, that is, a temperature in the range of from 0 to about 80° C., preferably from about 1 to about 60° C., more preferably from about 5 to about 40° C., most preferably at about 40° C., and a water:oil system having a mass ratio of water:oil of from about 99:1 to about 9:1, wherein the oil is, for example, a dialkyl ether, in particular dioctyl ether, is capable of forming a Winsor type IV microemulsion.

Laundry is understood to mean the entirety of the washable textiles. Garments, curtains or bedding are understood to be textiles. Garments and bedding comprise, for example, shirts, T-shirts, dresses, jackets, sweaters, pants, blankets, slips, and covers. The textiles can comprise various materials, for example, natural fibers, chemical fibers or further materials.

The detergent composition used in the context of the method is provided, for example, by an automatic dosing system. For example, the detergent composition is provided by one or more containers (tanks or cartridges). For example, at least two containers are provided, wherein the content of the respective container differs at least in one component. On the one hand, different detergent compositions can be produced as needed in this way. On the other hand, in particular in connection with the method described here, this has the advantage that a part of the detergent composition can be applied to the laundry together with the steam, while another part of the detergent composition (which can in particular comprise heat-sensitive components) can be applied to the laundry separate from the steam.

When washing the laundry of the laundry load using the first wash liquor based on the microemulsion, a first temperature $T_x$ is preferably set, which is preferably at least about 10° C., and preferably at most about 60° C.

When washing the laundry of the laundry load using the first wash liquor, substantially no free liquor is present, which enables a particularly water-saving washing. Washing the laundry of the laundry load using the first wash liquor can be referred to as a first wash cycle.

The fact that the first wash liquor is based on the microemulsion can in particular mean that the first wash liquor includes the first microemulsion. However, it is also possible that further detergent components and/or water are added to form the first wash liquor.

The method can be carried out, for example by a washing machine, in particular a household washing machine. However, controlling or triggering of individual or all method steps can also be effected by one or more devices separate from the washing machine, in particular one or more data processing devices (for example, a server, a smartphone, a tablet and/or a smartwatch).

According to a preferred embodiment of the method, the microemulsion is generated by the detergent composition and the moisture of the steam. It is therefore preferred that no further water is needed. Rather, a microemulsion can already be formed solely based on the moisture introduced by the steam.

According to a further preferred embodiment of the method, the detergent composition or a part thereof is introduced into the steam and applied to the laundry of the laundry load together with the steam. The detergent composition or a part thereof is thus introduced into the steam, in particular after the steam generation but before the introduction of the steam into the washing drum. This allows in particular an immediate activation of the detergent composition on the laundry of the laundry load. In addition, a spot formation, that is, a local over-concentration of the detergent, is avoided. Alternatively or additionally, it is likewise possible for the detergent composition or a part thereof to already be introduced into the water used for this purpose before the steam is generated.

In one example, the microemulsion is already formed by incorporating the detergent composition (or a part thereof) into the steam and/or the water used to generate the steam. The microemulsion can then be applied directly to the laundry of the laundry load with the steam.

However, it is also conceivable that a part of the components of the detergent composition are not applied to the laundry of the laundry load with the steam. This is particularly preferred when the detergent composition contains heat-sensitive components (such as enzymes).

It is possible, in particular, for the microemulsion to be formed only on the laundry of the laundry load. For example, only a part of the components of the detergent composition required to form the microemulsion are applied to the laundry with the steam. One or more further components (in particular required to form the microemulsion), for example, are not applied with the steam to the laundry of the laundry load.

According to a further preferred embodiment of the method, this further comprises:

determining an amount of the detergent composition to be dosed to form the microemulsion, in particular based at least on the amount of laundry of the laundry load, an amount of water used or to be used to produce the first wash liquor and/or a water property of the water used or to be used to produce the first wash liquor.

In this way, it can be ensured that, in particular with different quantities of laundry, water quantities and/or water properties, a microemulsion for the first wash liquor is formed reliably, in particular without doubt. In this case, the smallest possible amount of the detergent composition which forms or can form a microemulsion is preferably used.

For example, the amount of the detergent composition to be dosed is determined based on the weight and/or the volume of the laundry of the laundry load. Preferably, for this purpose, an anhydrous weight of the laundry of the laundry load is determined.

For example, the amount of the detergent composition to be dosed is determined based on the weight and/or the volume of water used or to be used to produce the first wash liquor. For example, this is done by measuring the flow rate of the water. In this case, an amount of water which leads to the production of the desired liquor ratio is used, which is described in more detail below.

A water property of the water used or to be used for producing the first wash liquor is, for example, the hardness of the water. For this purpose, for example, a variable can be determined which is representative of the hardness of the water. For example, a conductivity measurement is performed. In particular, this enables a minimum dosage of the detergent composition without risking under dosage.

For example, the amount of the detergent composition to be dosed to form the microemulsion is determined on the basis of data records (such as a matrix, look-up table) stored (in the washing machine or another device). It is also conceivable that the amount of the detergent composition to be dosed to form the microemulsion is determined algebraically.

In order to obtain a particularly uniform moisture penetration of the laundry of the laundry load, according to a further preferred embodiment of the method, the application of the steam to the laundry of the laundry load takes place by employing at least one nozzle. At the same time, if the detergent composition or a part thereof has been introduced into the steam, the application of the detergent composition or a part thereof to the laundry of the laundry load takes place, which leads to a uniform distribution. In addition, the at least one nozzle can also be used to apply water (for example, as an aerosol) and/or the detergent composition (or parts thereof) to the laundry without the use of steam.

For a particularly economical method, in particular with regard to water consumption, according to a further preferred embodiment of the method, the first wash liquor is a substantially completely bound liquor. A substantially completely bound liquor is understood to mean that essentially no free liquor is present.

According to a further preferred embodiment of the method, the liquor ratio of the first wash liquor is lower than about 1:1.5, preferably lower than about 1:1, more preferably lower than about 1:0.5, particularly preferably lower than about 1:0.25. The liquor ratio (in the textile industry often abbreviated as FV) is understood to mean the ratio of amount (weight in kg) of the laundry of the laundry load to the amount (in L) of the liquor. The lower the liquor ratio, the lower the amount of liquor. At low liquor ratios (for example, about 1:4 or lower) one also speaks of a short liquor. It has been found that, in particular, extremely short wash liquors are to be realized by employing the steam application. As a result, the concentration of active substance is increased and the treatment step is more efficient.

According to a further preferred embodiment of the method, steam is applied to the laundry of the laundry load and, in particular, the microemulsion is applied at least temporarily while the washing drum is rotated at a (first) rotational speed. Preferably, the first rotational speed ($w_1$) is selected so that the laundry of the laundry load lies loosely, but is not pressed, against the washing drum wall. The first rotational speed is, for example, at least about 10 rpm, preferably at least about 40 rpm and/or at most about 100 rpm, preferably at most about 80 rpm.

To improve the washing result using the microemulsion according to a further preferred embodiment of the method, the laundry of the laundry load is washed using the first wash liquor at least temporarily while rotating the washing drum at a (second) rotational speed, which is, in particular, less than the first rotational speed. The second rotational speed ($w_2$) is preferably selected so that the laundry of the laundry load can fall at top dead center (from about 11 to about 12 h). The second rotational speed is, for example, at least about 10 rpm, preferably at least about 30 rpm and/or at most about 100 rpm, preferably at most about 60 rpm. Washing using the first wash liquor takes place, for example, for a time ($t_{w1}$) of at least 3 minutes, preferably at least about 5 minutes, and/or at most about 180 minutes, preferably at most about 60 minutes.

According to a further embodiment of the method, the method further comprises:

applying at least one detergent component to the laundry of the laundry load separately from the application of steam to the laundry of the laundry load.

An application separate from the steam has the advantage that in particular heat-sensitive detergent components do not have to be applied together with the steam, which can jeopardize the effectiveness of the detergent component or even of the entire detergent composition. The at least one detergent component can be a part of the detergent composition. The laundry of the laundry load can thus be washed (moreover) on the basis of the at least one detergent component applied in this way. The at least one detergent component can be carried out, for example, in time after the application of the steam to the laundry of the laundry load. Alternatively or additionally, the at least one detergent component can be effected by employing at least one nozzle which is different from the at least one nozzle which is provided for the application of steam.

According to a further embodiment of the method, the method further comprises:

applying water to the laundry of the laundry load, in particular by employing at least one nozzle, for producing a second wash liquor, wherein in particular the liquor ratio of the second wash liquor is higher than the liquor ratio of the first wash liquor; and washing the laundry of the laundry load using the second wash liquor.

The water can be applied, for example, as an aerosol to the laundry via at least one nozzle. Alternatively, however, the water can also be applied in a gush manner to the laundry of the laundry load. Preferably, during the application of the water, the washing drum at least temporarily rotates at a (third) rotational speed, which is preferably greater than the second rotational speed. Preferably, the third rotational speed ($w_3$) is selected so that the laundry of the laundry load lies loosely, but is not pressed, against the washing drum wall. The third rotational speed is, for example, at least about 10 rpm, preferably at least about 40 rpm and/or at most about 100 rpm, preferably at most about 80 rpm.

The application of water produces a second wash liquor. Washing the laundry of the laundry load using the second wash liquor can be referred to as a second wash cycle. The liquor ratio is preferably higher than about 1:1. The second liquor ratio is preferably set so that a free liquor is present. A second temperature $T_y$ (post-wash temperature) is set in the second wash liquor, which temperature is preferably lower than the first temperature $T_x$. Preferably, the second temperature $T_y$ is at least about 10° C. and/or at most about 40° C.

During the washing of the laundry of the laundry load using the second wash liquor, the washing drum preferably rotates at least temporarily at a (fourth) rotational speed, which is preferably lower than the third rotational speed. The fourth rotational speed ($w_4$) is preferably selected so that the laundry of the laundry load can fall at top dead center (from about 11 to about 12 h). The fourth rotational speed is, for example, at least about 10 rpm, preferably at least about 30 rpm and/or at most about 100 rpm, preferably at most about 60 rpm. Optionally, an increase (in particular repeated) of the rotational speed to $w_3$ and reduction to $w_4$ can take place. Washing using the second wash liquor takes place, for example, for a time ($t_{w2}$) of at least about 3 minutes, preferably at least about 5 minutes, and/or at most about 180 minutes, preferably at most about 60 minutes. Additionally or alternatively, the washing using the second wash liquor can be terminated as a function of a property (in particular an optical characteristic value and/or an electrical characteristic value) of the second wash liquor. If the current optical characteristic value and/or electrical characteristic value deviates, for example, too far from a respective reference value, washing using the second wash liquor can be continued. If, for example, the difference of the current optical characteristic value and/or electrical characteristic value to a respective reference value is small enough, the washing using the second wash liquor can be terminated.

After the termination of the washing using the second wash liquor, according to a further embodiment of the method, a stripping off of the second wash liquor preferably takes place. For this purpose, the washing drum rotates at least temporarily at a (fifth) rotational speed ($w_5$), which is preferably greater than the fourth rotational speed $w_4$. Preferably, the fifth rotational speed ($w_5$) is selected so that the laundry of the laundry load rests firmly against the washing drum wall. The third rotational speed is, for example, at least about 400 rpm, preferably at least about 600 rpm and/or at most about 2000 rpm, preferably at most about 1600 rpm. The second wash liquor stripped off thereby from the laundry of the laundry load is preferably pumped out at the same time. The expulsion of the second wash liquor is preferably carried out for a time to of at least about 1 min, preferably at least about 3 min and/or at most about 60 min, preferably at most about 20 min. The expulsion of the second wash liquor is also preferably terminated when it is determined that a measured value of the pump for pumping out the water (for example, the power consumption) is below a threshold value.

According to a further embodiment of the method, the method further comprises:

applying water to the laundry of the laundry load to produce a rinse liquor; and rinsing the laundry of the laundry load using the rinse liquor.

The water can be applied, for example, as an aerosol to the laundry via at least one nozzle. Alternatively, however, the water can also be applied in a gush manner to the laundry of the laundry load. During the application of the water and/or during the rinsing, the washing drum preferably rotates at least temporarily at the already described (fifth) rotation speed $w_5$. The application of water produces a rinse liquor. Rinsing the laundry of the laundry load using the rinse liquor can be referred to as a rinse cycle. The rinsing is preferably carried out for a time $t_{s2}$ of at least about 1 min, preferably at least about 3 min and/or at most about 60 min, preferably at most about 20 min. Rinsing using the rinse liquor is preferably terminated as a function of a property (in particular an optical characteristic value and/or an electrical characteristic value) of the rinse liquor. For example, if the current characteristic value deviates too far from a respective reference value, rinsing using the rinse liquor can be preset or repeated. If, for example, the difference between the current characteristic value and a respective reference value is small enough, rinsing using the rinse liquor can be terminated.

Subsequently, the washing drum preferably rotates at least temporarily at a (sixth) rotational speed ($w_{max}$). The sixth rotational speed is, for example, at least about 400 rpm, preferably at least about 600 rpm and/or at most about 2000 rpm, preferably at most about 1600 rpm.

According to a further embodiment of the method, the method further comprises:

determining one or more optical characteristic values and/or electrical characteristic values of the microemulsion, the first wash liquor, the second wash liquor and/or the rinse liquor.

In particular, the determination can be a repeated determination. In particular, the determined values can influence the control of the method, in particular the length or repetition number of individual method portions, as already described.

An optical characteristic value is, for example, a turbidity value or a scatter value. Such a value can be determined, for example, by determining the light transmittance, the scattering, the reflection and/or the absorption of light in the respective medium (microemulsion, first wash liquor, second wash liquor, rinse liquor). Corresponding sensors can be provided for this purpose.

An example of an electrical characteristic value is the conductivity or conductance. This can be determined by way of example where a voltage U is applied to two electrodes having an area A and a self-adjusting current I. The current I results from the passage of a quantity of positive and negative ions through the control surface A (the electrodes) per unit of time (for example, second). The conductance of such an ionic conductor results in C=I/U and can be calculated as the reciprocal of the electrical resistance of the system (1/R=I/U).

Such a value can be reliably determined in particular in the second sub-washing cycle using the second wash liquor or during the final rinsing using the rinse liquor since a free liquor is typically present here. If, for example, the determined value is greater than a reference value (for example, greater than a defined value or as an optical or electrical characteristic value of the microemulsion or the first wash liquor) or if the determined value increases, the corresponding method portion (for example, the second sub-wash cycle or rinsing) can be extended or repeated. Namely, a rise in optical characteristic values, such as the turbidity value or the scattering value, can be a sign of the further washing out of dirt. A rise in an electrical characteristic value such as the conductance can be a sign of a still ongoing phase reversal process.

According to a further embodiment of the method, the method further comprises: querying and/or obtaining information representative of the effectiveness of a wash result with respect to the washed laundry of the laundry load. For example, obtaining information can be automated (for example, by the washing machine). This can be done, for example, by employing sensors (for example, using optical sensors for detecting the laundry or with sensors with whose aid the degree of soiling of the rinse water of a (last) rinse cycle can be determined). Alternatively or additionally, this information can also be queried, for example, by the user (for example, by a data processing system such as a smartphone) after washing and then obtained. In one example, the information representative of the effectiveness of the treatment can be recorded in a user profile.

On the basis of the information obtained representative of the effectiveness of the washing result and/or by detecting further washing parameters described herein (for example, the amount of the detergent composition to be dosed, the liquor ratio, the temperature, the duration, the amount of water, the speed of rotation, etc.), an optimization the washing process can preferably take place.

It is also possible that the optimization of the washing operation comprises or is based on machine learning, particularly in the use of information representative of the effectiveness of a wash result. Machine learning is understood as meaning an artificial system (for example, a device according to the second aspect or a system according to the third aspect) that learns, for example, from examples and can generalize them after the end of the learning phase. That is, the examples are not simply learned by heart, but rather patterns and principles are recognized in the learning data. Different approaches can be followed for this purpose. For example, supervised learning, partially supervised learning, unsupervised learning, empowered learning, and/or active learning can be used, in particular in conjunction with deep learning methods. Supervised learning can be done, for example, by employing an artificial neural network (such as a recurrent neural network) or by employing a support vector machine. Unsupervised learning can also take place, for example, by employing an artificial neural network (for example, an auto-encoder). For example, in particular, the information obtained (repeatedly) that is representative of the effectiveness of a wash result and/or the detected wash parameters is then used as the learning data.

The object mentioned in the introduction is achieved in a device where the device is configured for this purpose or comprises corresponding features for carrying out and/or controlling a method as contemplated herein.

An exemplary device comprises at least one processor and at least one memory with computer program code, wherein the at least one memory and the computer program code are configured to execute and/or control at least one method as contemplated herein with the at least one processor. For example, a processor is understood as meaning a control unit, a microprocessor, a microcontrol unit such as a microcontroller, a digital signal processor (DSP), an application specific integrated circuit (ASIC), or a field programmable gate array (FPGA).

For example, an exemplary device further comprises features for storing information items such as a program memory and/or a main memory. For example, an exemplary device as contemplated herein further comprises features for receiving and/or sending information items over a network, such as a network interface. For example, exemplary devices as contemplated herein are connected to each other and/or connectable to each other via one or more networks.

An exemplary device is or comprises, for example, a washing machine or a data processing system which is configured in terms of software and/or hardware in order to be able to execute the respective steps of a method as contemplated herein. Examples of a data processing system include a computer, a desktop computer, a server, a thin client and/or a portable computer (mobile device), such as a laptop computer, a tablet computer, a wearable, a personal digital assistant or a smart phone.

Individual method steps of the method as contemplated herein, which, for example, do not necessarily have to be carried out using the washing machine, can be performed by a further device, which is in particular connected to the washing machine via a communication system. Such method steps are, for example, determining an amount of the detergent composition to be dosed to form the microemulsion and/or controlling/triggering method steps carried out by the washing machine (for example, applying at least one detergent component, applying water, washing the laundry and/or rinsing the laundry). In other words, the method steps described or the control thereof (if this does not necessarily have to be done in the device (washing machine) carrying out the washing of the laundry itself) need not therefore be carried out only locally in or by the washing machine, but are also performed by a separate device of the user (such as one of the described data processing systems of the user, such as a smartphone, tablet, etc.) or by a device such as a remote server ("remote").

Thus, in addition to the washing machine, further devices can be provided, for example, a server and/or, for example, a part or a component of a so-called computer cloud, which provides data processing resources dynamically for different users in a communication system. A computer cloud is understood, in particular, as meaning a data processing infrastructure as defined by the National Institute for Standards and Technology (NIST) for the English term "cloud computing". An example of a computer cloud is a Microsoft Windows Azure Platform.

The object mentioned in the introduction is further achieved by a computer program which comprises program instructions which cause a processor to execute and/or control a method as contemplated herein when the computer program is running on the processor. An exemplary program as contemplated herein can be stored in or on a computer-readable storage medium containing one or more programs.

The object mentioned in the introduction is further achieved by a computer-readable storage medium which contains a computer program as contemplated herein. A computer-readable storage medium can be formed, for example, as a magnetic, electrical, electro-magnetic, optical and/or other type of storage medium. Such a computer-readable storage medium is preferably graphical (that is, "touchable"), for example, it is formed as a data carrier device. Such a data carrier device is for example, portable or permanently installed in a device. Examples of such a data carrier device are volatile or non-volatile random access memory (RAM) such as NOR flash memory or having sequential access such as NAND flash memory and/or read-only access memory (ROM) or read-write access. For example, computer readable is to be understood as meaning that the storage medium can be read and/or written by a computer or a data processing system, for example, by a processor.

Finally, the object mentioned in the introduction is achieved by a system comprising a washing machine and a data processing system, which are jointly configured to execute and/or control a method as contemplated herein. The data processing system is, for example, a mobile device or a server for carrying out at least part of the method.

The exemplary embodiments of the present disclosure described above in this description are also to be understood as being disclosed in all combinations with one another. In particular, exemplary embodiments are to be understood in terms of the different subjects disclosed.

In particular, the preceding or following description of method steps according to preferred embodiments of a method also discloses corresponding features for performing the method steps by preferred embodiments of a device. Likewise, by the disclosure of employing a device for performing a method step, the corresponding method step is also disclosed.

FIG. 1 shows a schematic block diagram of an embodiment of a device 100 as contemplated herein, which is formed here as a washing machine, to illustrate an embodiment of a method as contemplated herein.

A laundry load (not illustrated) is introduced in the container B2 formed as a washing drum B2. The weight of the laundry of the laundry load is determined via sensor W by employing an anhydrous method.

The device 100 is supplied water via the valve V1. The amount of water that is used in different method portions (for example, for steam generation) can be determined by employing the impeller flow meter F1. The conductivity can also be determined as an electrical characteristic value of the water by employing the sensor C1.

Water is supplied to the steam generator WT1 via the pump P1, which generates steam. The steam can be supplied to the washing drum B2 via valve V2, so that steam can be applied to the laundry of a laundry load located therein via the nozzle D1. The nozzle D1 ensures a uniform distribution of the steam in the washing drum B2.

The moisture added to the washing drum B2 in this case is selected so that the liquor ratio of the first wash liquor to be produced is lower than about 1:1.5. Even a liquor ratio of about 1:0.25 can be achieved by using steam.

On the basis of the amount of laundry of the laundry load, the amount of water used or to be used to produce the first wash liquor, and a water property (here the conductivity measured via sensor C1) of the water used or to be used to produce the first wash liquor, an amount of a detergent composition to be dosed to form a microemulsion is determined.

The detergent composition or certain components thereof are stored in container B1. Moreover, the detergent composition (or certain components thereof) from container B1 can be introduced into the steam via pump P2 and applied together with the steam to the laundry of the laundry load. As a result, a microemulsion can already be produced in the steam or in any case on the laundry of the laundry load. However, it is conceivable that even more components of the detergent composition or further water are applied by other means to the laundry of the laundry load. An application of at least one detergent component to the laundry of the laundry load, separate from the application of the steam to the laundry of the laundry load, is particularly advantageous in the case of heat-sensitive components.

The application of steam to the laundry of the laundry load and in particular applying the microemulsion takes place at least temporarily while rotating the washing drum B2 by employing motor M at a first rotational speed. The current consumption of the motor can be determined and monitored via sensor I and the speed of the washing drum via sensor S.

Subsequently, the laundry of the laundry load can be washed using a first wash liquor based on the generated microemulsion. The first wash liquor is in this case a substantially completely bound liquor and there is essentially no free liquor present. The washing of the laundry of the laundry load using the first wash liquor takes place at least temporarily while rotating the washing drum B2 at a second rotational speed, which is lower than the first rotational speed.

The sensors P and T are used to monitor pressure and temperature in the washing drum B2.

Water can be supplied to the washing drum B2 independently of the steam generator WT1 via the pump P3 and the second nozzle D2. Water thus is applied to the laundry of the laundry load by employing the nozzle D2 to produce a second wash liquor. The liquor ratio of the second wash liquor is higher than the liquor ratio of the first wash liquor. The laundry of the laundry load is then washed using the second wash liquor. In this case, the second wash liquor can be pumped in a circle via the circuit Z1.

A subsequent dosing of the detergent composition via pump P2 can also take place. If necessary, this is done using a further addition of water via the pump P1, if necessary, however, without the operation of the steam generator WT1, so that the nozzle D1, for example, discharges an aerosol. The subsequently dosed detergent is also evenly distributed through the nozzle D1.

The washing using the second wash liquor is continued or terminated as a function of a property, such as an optical characteristic value (such as the turbidity value) and/or an electrical characteristic value (such as the conductivity or conductance) of the second wash liquor. These values are measured via sensor unit A (which can also be representative of several sensors).

Subsequently, water is applied to the laundry of the laundry load to produce a rinse liquor. This can be done in particular via pump P3. The laundry of the laundry load is then rinsed using the rinse liquor. Also in this case, rinsing using the rinse liquor can be continued or terminated depending on a property such as an optical characteristic value (such as the turbidity value) and/or an electrical characteristic value (such as conductivity or conductance) of the rinse liquor. These values can also be measured via sensor unit A.

Free liquor, such as, for example, the second wash liquor or the rinse liquor, can be removed from washing drum B2 via valve V4 and pump P4.

Figure 2:
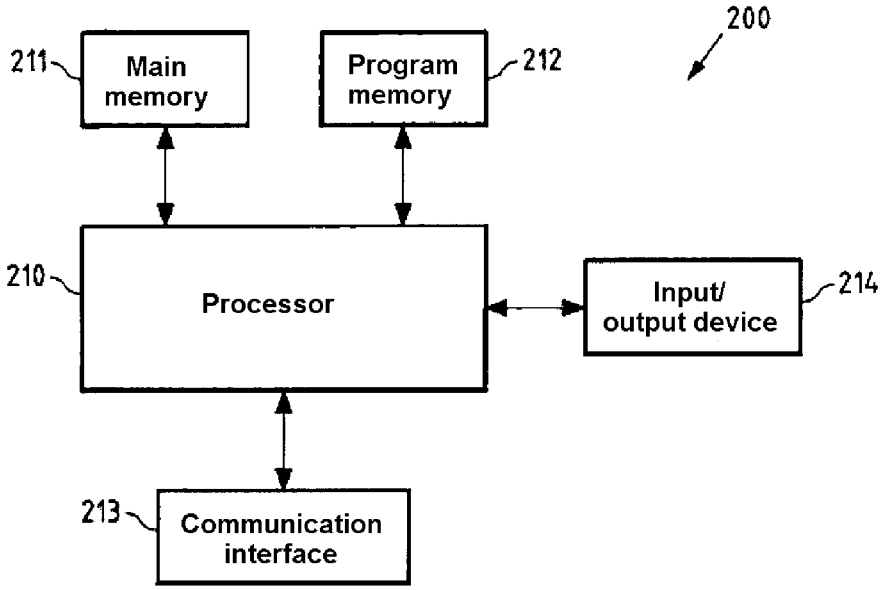
FIG. 2 illustrates a block diagram of an embodiment of a device as contemplated herein.

FIG. 2 shows a block diagram of an embodiment of a device 200, which, in particular, can control an exemplary method according to the first aspect. The device 200 can be part of the device 100, for example, or a separate device.

In particular, the device 200 can be a computer, a desktop computer, a server, a thin client, or a portable computer (mobile device), such as a laptop computer, a tablet computer, a personal digital assistant (PDA), or a smartphone. For example, the device can fulfill the function of a server or a client.

Processor 210 of device 200 is particularly formed as a microprocessor, microcontrol unit, microcontroller, digital signal processor (DSP), application specific integrated circuit (ASIC) or field programmable gate array (FPGA).

Processor 210 executes program instructions stored in program memory 212 and, for example, stores intermediate results or the like in working or main memory 211. For example, program memory 212 is a nonvolatile memory such as a flash memory, a magnetic memory, an EEPROM memory (electrically erasable programmable read only memory), and/or an optical memory. Main memory 211 is, for example, a volatile or non-volatile memory, in particular, a random access memory (RAM) such as a static RAM (SRAM), a dynamic RAM (DRAM), a ferroelectric RAM (FeRAM), and/or a magnetic RAM memory (MRAM).

Program memory 212 is preferably a local data carrier permanently attached to device 200. Data carriers permanently connected to the device 200 are, for example, hard disks which are built into the device 200. Alternatively, the data carrier can, for example, also be a data carrier which can be connected in separable manner to the device 200, such as a memory stick, a removable data carrier, a portable hard disk, a CD, a DVD and/or a diskette.

Program memory 212 contains, for example, the operating system of device 200, which is at least partially loaded into main memory 211 and executed by processor 210 when device 200 is started. In particular, when device 200 starts, at least one part of the kernel of the operating system is loaded into main memory 211 and executed by processor 210. The operating system of device 400 is, for example, a Windows, UNIX, Linux, Android, Apple iOS, and/or MAC operating system.

In particular, the operating system enables the use of the device 200 for data processing. It manages, for example, resources such as main memory 211 and program memory 212, network interface 213, input and output device 214, provides basic functions, among other things through programming interfaces, to other programs and controls the execution of programs.

Processor 210 controls the communication interface 213, which can be, for example, a network interface and can be in the form of a network card, network module and/or modem. The communication interface 213 is, in particular, configured to establish a connection of the device 200 to other devices, in particular, via a (wireless) communication system, for example, a network, and to communicate with them. The communication interface 213 can, for example, receive data (via the communication system) and forward it to processor 210 and/or receive and send data (via the communication system) from processor 210. Examples of a communication system are a local area network (LAN), a wide area network (WAN), a wireless network (for example, according to the IEEE 802.11 standard, the Bluetooth (LE) standard and/or the NFC standard), a wired network, a mobile network, a telephone network and/or the Internet. If device 200 is a device that is different from the washing machine 100, the device 200 can communicate via communication interface 213 with, for example, washing machine 100, which in this case also has a communication interface.

Furthermore, processor 210 can control at least one input/output device 214. Input/output device 214 is, for example, a keyboard, a mouse, a display unit, a microphone, a touch-sensitive display unit, a loudspeaker, a reading device, a drive and/or a camera. For example, input/output device 214 can receive inputs from a user and forward them to processor 210 and/or receive and output information items to the user of processor 210.

Figure 3:
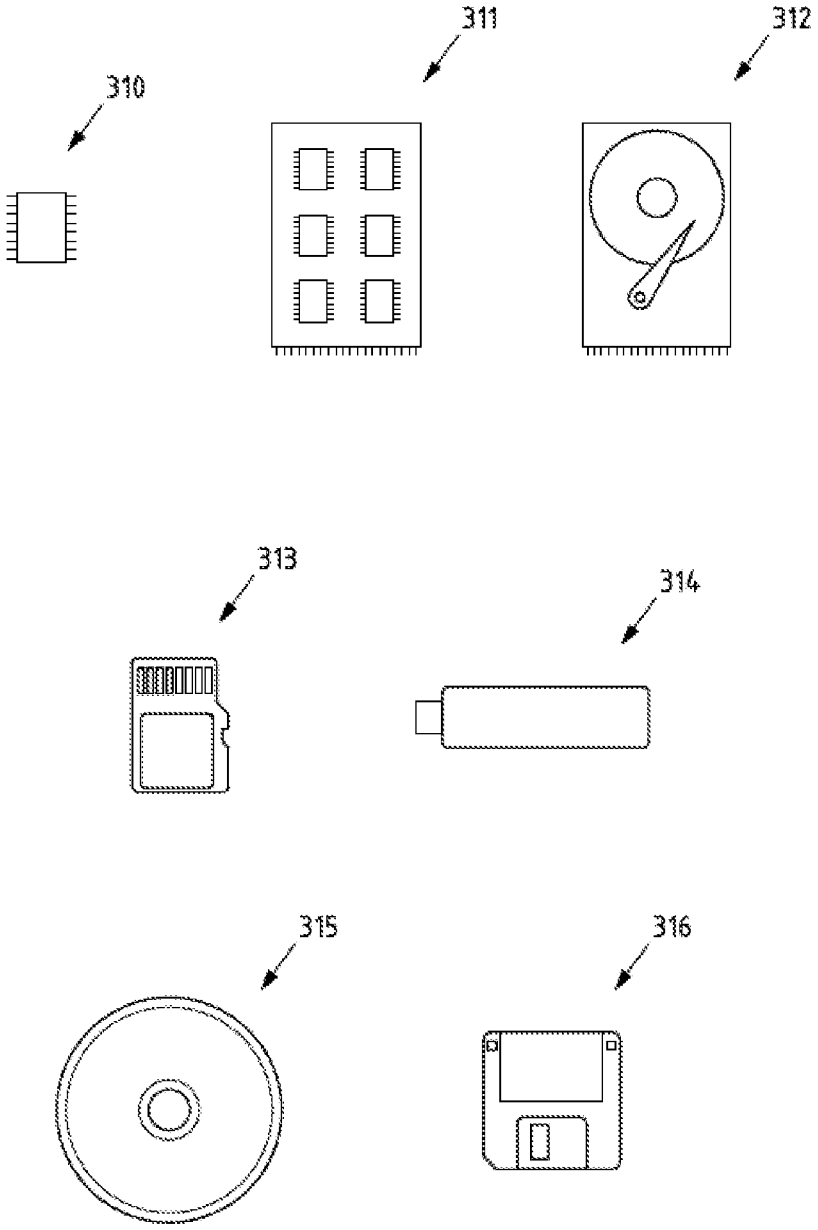
FIG. 3 illustrates different embodiments of storage media.

Finally, FIG. 3 shows different embodiments of storage media on which an embodiment of a computer program as contemplated herein can be stored. The storage medium can be, for example, a magnetic, electrical, optical and/or other type of storage medium. For example, the storage medium can be part of a processor (for example, processor 210 of FIG. 2), such as a (non-volatile or volatile) program memory of the processor or a part thereof (such as program memory 212 in FIG. 2). Embodiments of a storage medium are a flash memory 210, an SSD hard disk 211, a magnetic hard disk 212, a memory card 213, a memory stick 214 (for example, a USB stick), a CD-ROM or DVD 215, or a diskette 216.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the various embodiments in any way. Rather, the foregoing detailed description will provide those skilled in the art with a convenient road map for implementing an exemplary embodiment as contemplated herein. It being understood that various changes may be made in the function and arrangement of elements described in an exemplary embodiment without departing from the scope of the various embodiments as set forth in the appended claims.

The invention claimed is:

1. A method for washing laundry of a laundry load in a washing drum and carried out by at least one device, the method comprising the steps of:

generating steam and applying the steam to the laundry of the laundry load;

determining an amount of a detergent composition to be dosed to generate a microemulsion based at least on (i) an amount of the laundry of the laundry load, (ii) an amount of water used or to be used to produce a first wash liquor, and (iii) a water property of the water used or to be used to produce the first wash liquor;

generating the microemulsion by dosing the amount of the detergent composition; and washing the laundry of the laundry load using the first wash liquor based on the microemulsion, wherein:

the detergent composition or part thereof is introduced into the steam and applied to the laundry of the laundry load together with the steam, and the microemulsion is produced by the detergent composition and moisture of the steam.

2. The method according to claim 1, wherein the steam is applied to the laundry of the laundry load by employing at least one nozzle.

3. The method according to claim 1, wherein the first wash liquor is a substantially completely bound liquor.

4. The method according to claim 1, wherein a liquor ratio of the first wash liquor is lower than about 1:1.5.

5. The method according to claim 1, wherein application of the steam to the laundry of the laundry load takes place at least temporarily while rotating the washing drum at a first rotational speed.

6. The method according to claim 5, wherein washing of the laundry of the laundry load using the first wash liquor takes place at least temporarily while rotating the washing drum at a second rotational speed which is less than the first rotational speed.

7. The method according to claim 1, further comprising the step of:

applying at least one detergent component to the laundry of the laundry load separately from application of the steam to the laundry of the laundry load.

8. The method according to claim 1, further comprising the steps of:

applying water to the laundry of the laundry load by employing at least one nozzle for producing a second wash liquor, wherein a liquor ratio of the second wash liquor is higher than a liquor ratio of the first wash liquor; and washing the laundry of the laundry load using the second wash liquor.

9. The method according to claim 8, further comprising the step of:

applying water to the laundry of the laundry load to produce a rinse liquor; and rinsing the laundry of the laundry load using the rinse liquor.

10. The method according to claim 9, further comprising the step of:

determining one or more turbidity values and/or electrical characteristic values of the microemulsion, the first wash liquor, the second wash liquor and/or the rinse liquor.

11. The method according to claim 1, further comprising the step of:

querying and/or obtaining information representative of an effectiveness of a wash result with respect to the washed laundry of the laundry load.

* * * * *